US008763675B2

(12) United States Patent
Zhu

(10) Patent No.: US 8,763,675 B2
(45) Date of Patent: Jul. 1, 2014

(54) BEAD CHAIN TYPE PULL CORD MECHANISM FOR A WINDOW SHADE

(76) Inventor: Xiang-Rong Zhu, Flatad-Tongnamahjardim (MO)

( * ) Notice: Subject to any disclaimer, the term of this patent is extended or adjusted under 35 U.S.C. 154(b) by 301 days.

(21) Appl. No.: 13/241,621

(22) Filed: Sep. 23, 2011

(65) Prior Publication Data

US 2012/0285635 A1 Nov. 15, 2012

(30) Foreign Application Priority Data

May 13, 2011 (CN) ..... 2011 1 0123941

(51) Int. Cl.
*E06B 9/56* (2006.01)
*A47G 5/02* (2006.01)
*A47H 1/00* (2006.01)

(52) U.S. Cl.
USPC ..... 160/321

(58) Field of Classification Search
USPC ..... 254/391; 160/168.1 V, 168.1 P, 176.1 V, 160/178.1 V, 243, 307, 308, 319, 320, 321, 160/340, 344, 345, 346, 347; 241/168.1 V, 241/168.1 P, 176.1 V, 178.1 V, 243, 307, 241/308, 319, 320, 321, 340, 344, 345, 346, 241/347
See application file for complete search history.

(56) References Cited

U.S. PATENT DOCUMENTS

| | | | | |
|---|---|---|---|---|
| 4,513,805 | A | 4/1985 | Mase | 160/299 |
| 5,465,775 | A | 11/1995 | Biba et al. | 160/168.1 |
| 5,465,779 | A | 11/1995 | Rozon | 160/168.1 |
| 5,513,687 | A * | 5/1996 | Tuzmen et al. | 160/168.1 R |
| 5,553,650 | A * | 9/1996 | Jelic | 160/178.1 R |
| 5,595,232 | A * | 1/1997 | Benthin | 160/178.1 R |
| 5,709,258 | A | 1/1998 | Coccoluto | 160/168.1 |
| 6,792,999 | B2 * | 9/2004 | Cross et al. | 160/321 |
| 7,353,857 | B2 * | 4/2008 | Koop | 160/178.1 R |
| 7,931,069 | B2 * | 4/2011 | Cannaverde et al. | 160/173 R |
| 8,286,686 | B2 * | 10/2012 | Cannaverde | 160/320 |
| 8,376,022 | B2 * | 2/2013 | Lin | 160/321 |
| 8,544,525 | B2 * | 10/2013 | Zhu | 160/321 |
| 2004/0261958 | A1 | 12/2004 | Sugiyama et al. | 160/296 |
| 2010/0314054 | A1 | 12/2010 | Zhu | 160/294 |
| 2011/0011543 | A1 | 1/2011 | Zhu | 160/312 |

FOREIGN PATENT DOCUMENTS

| | | | |
|---|---|---|---|
| CN | 2251321 | 4/1997 | A47H 5/032 |
| CN | 2329751 | 7/1999 | E06B 9/68 |
| CN | 2725495 | 9/2005 | E06B 8/80 |
| CN | 10 1025073 | 8/2007 | E06B 9/68 |
| CN | 10 1139909 | 3/2008 | E06B 9/30 |

(Continued)

*Primary Examiner* — Katherine Mitchell
*Assistant Examiner* — Jeremy Ramsey
(74) *Attorney, Agent, or Firm* — Alan Kamrath; Kamrath IP Lawfirm, P.A.

(57) ABSTRACT

A window shade includes a frame (1), a shade (2), a shade driving mechanism (3), and a bead chain (4) for driving the shade (2) through the shade driving mechanism (3). A barrel (5) is mounted to the frame (1) at a location corresponding to the bead chain (4). A sliding block (7) is slideably received in the barrel (5) and connected to a handle (8) mounted outside of the barrel (5) by a link (9) extending through a slit (6) in the barrel (5). The bead chain (4) is wound around a fixed pulley (16) mounted to an end of the barrel (5). The sliding block (7) is fixed to a section (4*a*) of the bead chain (4) received in the barrel (5).

9 Claims, 5 Drawing Sheets

(56) References Cited

FOREIGN PATENT DOCUMENTS

| | | | |
|---|---|---|---|
| CN | 10 1139910 | 3/2008 | E06B 9/68 |
| CN | 10 1240691 | 8/2008 | E06B 9/68 |
| CN | 20 1106396 | 8/2008 | E06B 9/30 |
| CN | 20 1148833 | 11/2008 | E06B 9/68 |
| CN | 20 1152137 | 11/2008 | E06B 9/68 |
| CN | 10 1476443 | 7/2009 | E06B 9/68 |
| WO | WO2006 133639 | 12/2006 | E06B 9/40 |

* cited by examiner

BEAD CHAIN TYPE PULL CORD MECHANISM FOR A WINDOW SHADE

BACKGROUND OF THE INVENTION

The present invention relates to a bead chain type pull cord mechanism for a window shade.

The endless bead chains of currently available pull cord mechanisms for driving the shade driving mechanisms of window shades are exposed. Driven by their playful nature, a child often plays with the bead chain as a toy. However, the bead chain is soft and has two sections connected to the window shade, such that the bead chain is liable to tangle with the child by the neck and, thus, causes danger, which potential risk has not yet been effectively solved.

BRIEF SUMMARY OF THE INVENTION

An objective of the present invention is to provide a bead chain type pull cord mechanism for a window shade capable of effectively preventing the bead chain from tangling with a child.

The present invention fulfills the above objective by providing a window shade including a frame, a shade, a shade driving mechanism, and a bead chain for driving the shade driving mechanism. The shade driving mechanism is fixed to the frame to drive the shade to release or wind. A barrel is mounted to the frame at a location corresponding to the bead chain. The barrel includes a peripheral wall having a slit extending in an axial direction. A sliding block is slideably received in the barrel. A handle is mounted outside of the barrel. The sliding block is connected to the handle by a link extending through the slit. The bead chain includes first and second sections received in the barrel. A fixed pulley is mounted to an end of the barrel. The bead chain is wound around the fixed pulley. The sliding block is fixed to the first section of the bead chain in the barrel. In use, the sliding block is moved through moving the handle, causing movement of the bead chain, which, in turn, drives the shade driving mechanism to release the shade. Such structure is suitable for a shade driving mechanism having an elastic returning mechanism that can wind the shade when desired.

To allow easy control of the length of the shade to be released, the sliding block includes a passageway in an intermediate portion thereof. The first section of the bead chain in the barrel is fixed in an end of the passageway. The second section of the bead chain is slideably extended through the other end of the passageway. A stop member is pivotably mounted by a shaft to the sliding block. The stop member includes a stop and a pressing handle. In use, the pressing handle can be operated to pivot the stop to a position sandwiched between the first and second sections of the bead chain. Thus, the bead chain can not move in either of the upward and downward directions, preventing releasing and winding of the shade. The position of the released shade is, thus, controllable. On the other hand, the pressing handle can be operated to pivot the stop away from the first and second sections of the bead chain. In this case, the sliding block can be moved through moving the handle to cause movement of the bead chain, which, in turn, releases the shade. Alternatively, the elastic returning mechanism winds the shade when the stop is disengaged from the first and second sections of the bead chain. When applying such structure in the technique using a bead chain to release/wind the shade, further release of the released shade under the action of gravitational force can be effectively avoided to permit the user to control and retain the length of the released shade.

The link includes a channel in a central portion thereof. The pressing handle of the stop member is connected by the shaft to a peripheral wall of the channel. A spring is mounted between the channel and the stop. When no external force is applied, the stop is in the engaged position between the first and second sections of the bead chain to prevent movement of the bead chain. The pressing handle can be operated to move the stop away from the engaged position, allowing circulating movement of the bead chain.

To provide the bead chain with a certain tension for ensuring smooth, circulating motion of the bead chain, a pulley seat is mounted to the end of the barrel. The fixed pulley is rotatably mounted to the pulley seat. A compression spring is mounted between the pulley seat and the barrel.

To allow repeated smooth movement of the bead chain, the handle is a sleeve including a hole having cross sections corresponding to that of the cross sections of the barrel.

To provide the barrel with a guiding function, the hole of the barrel is cylindrical. The sliding block includes two ends each having an end face. Each of the end faces of the sliding block has a curve corresponding to that of the inner periphery of the hole of the barrel.

To increase the sliding effect of the sleeve, the sleeve and the sliding block are made of plastic.

In a form shown, the handle includes a receptacle in an outer periphery thereof. A spring is mounted between the pressing handle and an end wall of the receptacle. The spring biases the stop to the engaged position sandwiched between the first and second sections of the bead chain to prevent movement of the bead chain. The pressing handle can be operated to overcome the spring and to move the stop away from the engaged position, allowing circulating movement of the bead chain to drive the shade through the shade driving mechanism.

The sleeve includes a peripheral wall having a slot in communication with the channel. The pressing handle of the stop member extends outside of the slot.

Compared to the current techniques, the present invention can effectively prevent the bead chain from tangling with a child, providing use safety.

The present invention will become clearer in light of the following detailed description of illustrative embodiments of this invention described in connection with the drawings.

DETAILED DESCRIPTION OF THE INVENTION

Figure 1:
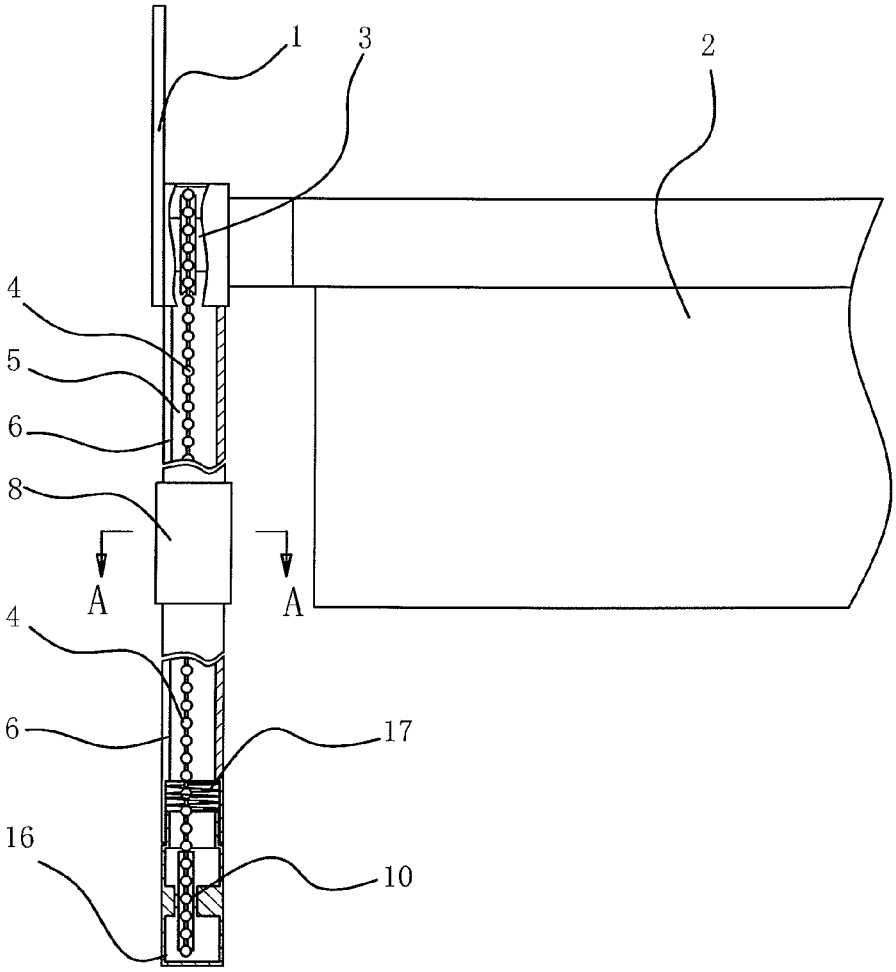
FIG. 1 shows a schematic view of a bead chain type pull cord mechanism for a window shade according to the present invention.

A window shade includes a frame 1, a shade 2, a shade driving mechanism 3, and a bead chain 4 for driving the shade driving mechanism 3. The shade driving mechanism 3 is fixed to the frame 1 and drives the shade 2 to release or wind. Particularly, a barrel 5 is mounted to the frame 1 at a location corresponding to the bead chain 4. The barrel 5 includes a peripheral wall having a slit 6 extending in an axial direction.

A sliding block 7 is slideably received in the barrel 5. A handle 8 is mounted outside of the barrel 5. The sliding block 7 is connected to the handle 8 by a link 9 extending through the slit 6. The bead chain 4 includes first and second sections 4*a* and 4*b* received in the barrel 5. A fixed pulley 10 is mounted to an end of the barrel 5. The bead chain 4 is wound around the fixed pulley 10. The sliding block 7 is fixed to the first section 4*a* of the bead chain 4 in the barrel 5. The shape of the cross sections 5*a* of the barrel 5 is one of square, rectangular, circular, elliptic, and polygonal.

The sliding block 7 includes a passageway 11 in an intermediate portion thereof. The first section 4*a* of the bead chain 4 in the barrel 5 is fixed in an end of the passageway 11. The second section 4*b* of the bead chain 4 is slideably extended through the other end of the passageway 11. A stop member 13 is pivotably mounted by a shaft 12 to the sliding block 7. The stop member 13 includes a stop 13*a* and a pressing handle 13*b*. The link 9 includes a channel 14 in a central portion thereof. The pressing handle 13*b* of the stop member 13 is connected by the shaft 12 to a peripheral wall of the channel 14. A spring 15 is mounted between the channel 14 and the stop 13*a*.

A pulley seat 16 is mounted to the end of the barrel 5. The fixed pulley 10 is rotatably mounted to the pulley seat 16. A compression spring 17 is mounted between the pulley seat 16 and the barrel 5.

The handle 8 is a sleeve having a hole 8*a*. The hole 8*a* has cross sections corresponding to that of the cross sections 5*a* of the barrel 5. The sleeve 8 includes a peripheral wall having a slot 18 in communication with the channel 14. The pressing handle 13*b* of the stop member 13 extends outside of the slot 18.

The hole 5*b* of the barrel 5 is cylindrical. The sliding block 7 includes two ends each having an end face 7*a*. Each of the end faces 7*a* of the sliding block 7 has a curve corresponding to that of the inner periphery of the hole 5*b* of the barrel 5. The sleeve 9 is made of plastic or aluminum alloy. The sliding block 7 is made of plastic or an aluminum alloy. The sliding block 7, the link 9, and the handle 8 are integrally formed of plastic by injection molding or integrally formed by processing aluminum alloy. The barrel 5 is made of an aluminum alloy or plastic.

In use, the sliding block 7 is moved through moving the handle 8, causing movement of the bead chain 4, which, in turn, drives the shade driving mechanism 3 to release the shade 2. Such structure is suitable for a shade driving mechanism 3 having an elastic returning mechanism that can wind the shade 2 when desired.

Figure 2:
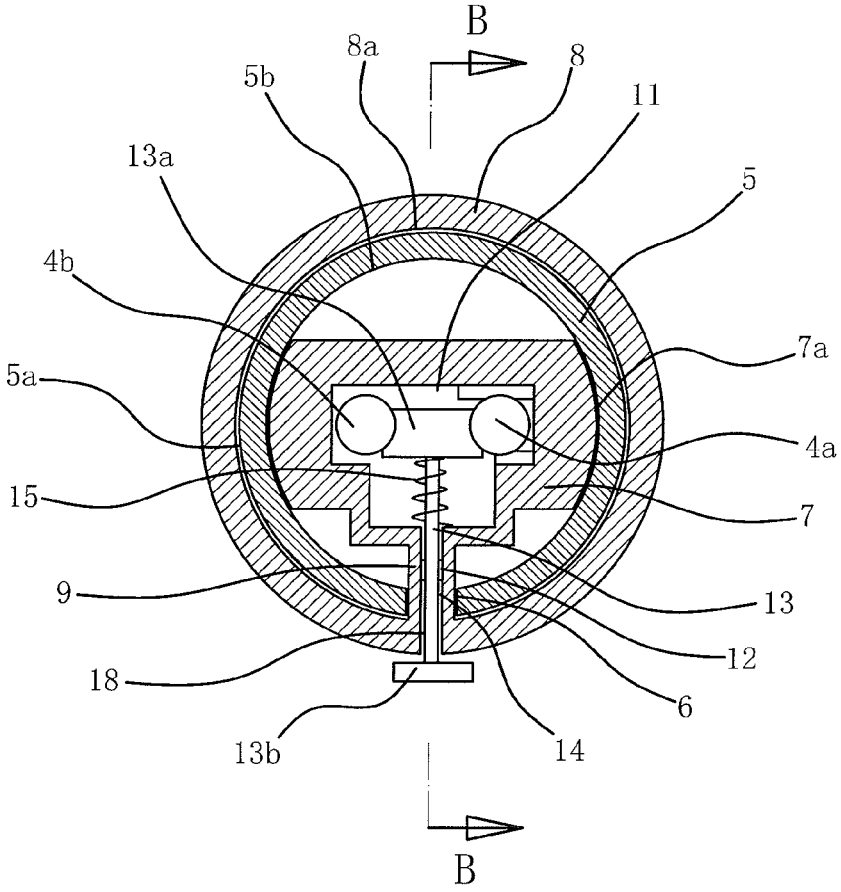
FIG. 2 shows a cross sectional view taken along section line A-A of FIG. 1.
Figure 3:
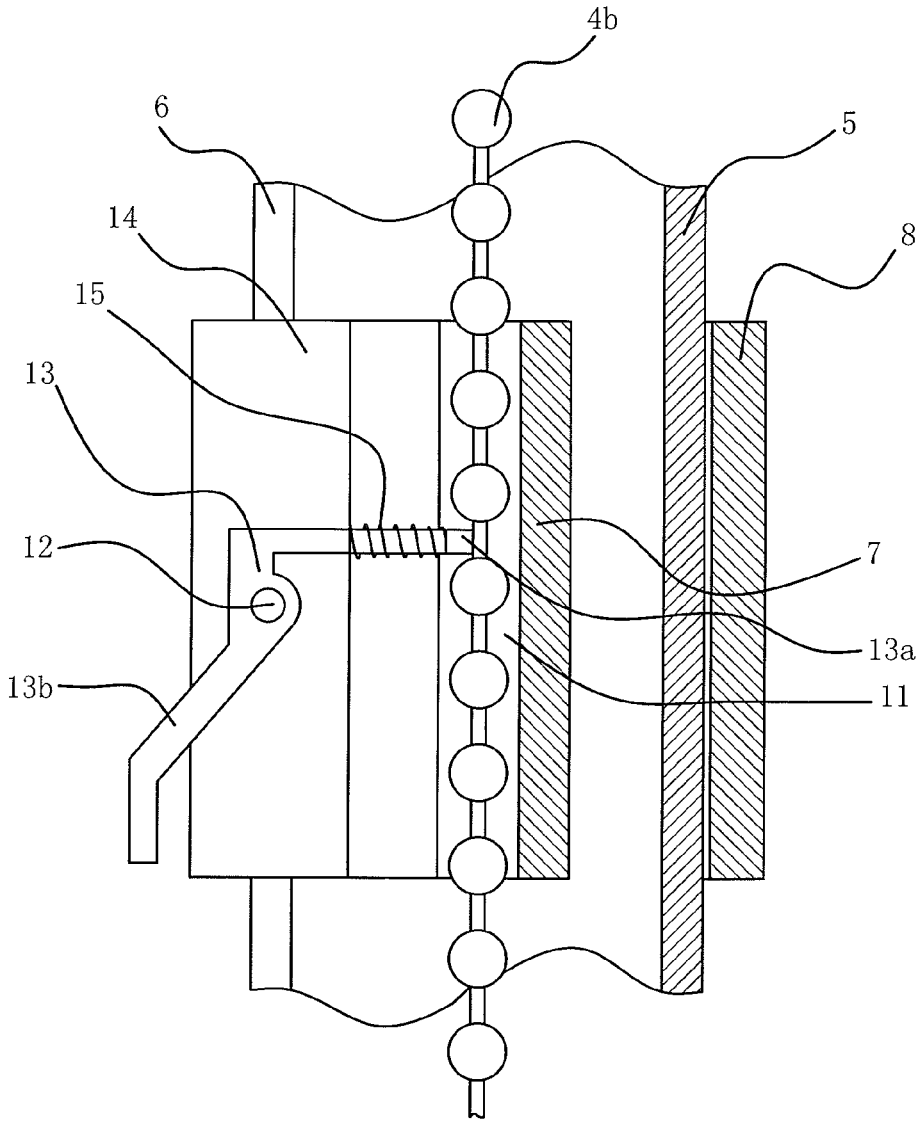
FIG. 3 shows a cross sectional taken view taken along section line B-B of FIG. 2.
Figure 4:
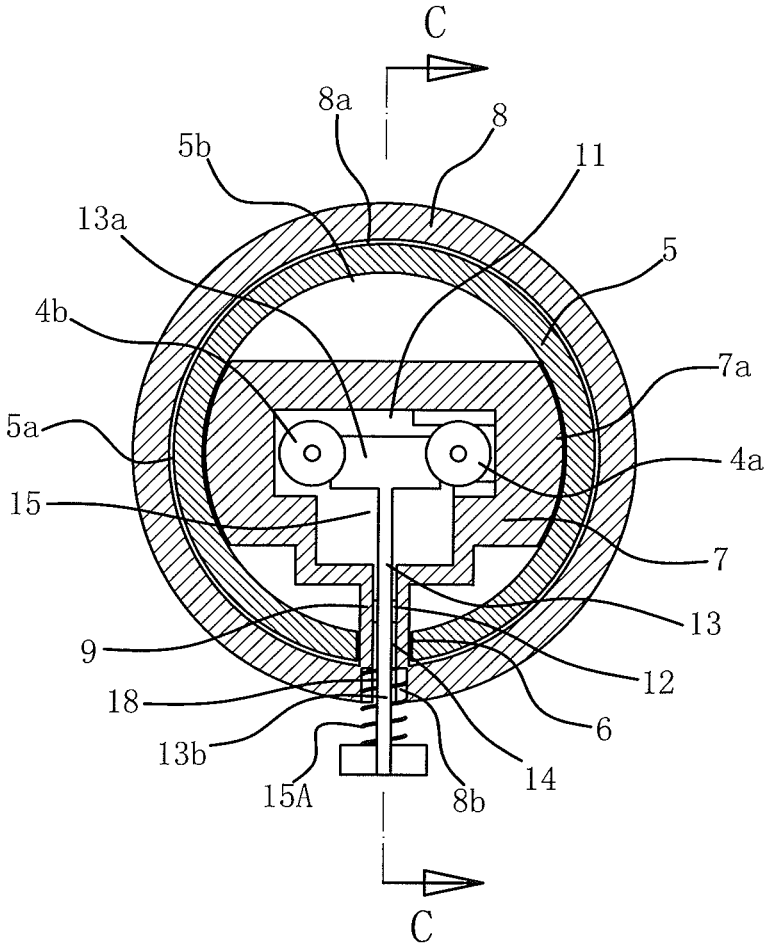
FIG. 4 shows a cross sectional view of another embodiment of the bead chain type pull cord mechanism.
Figure 5:
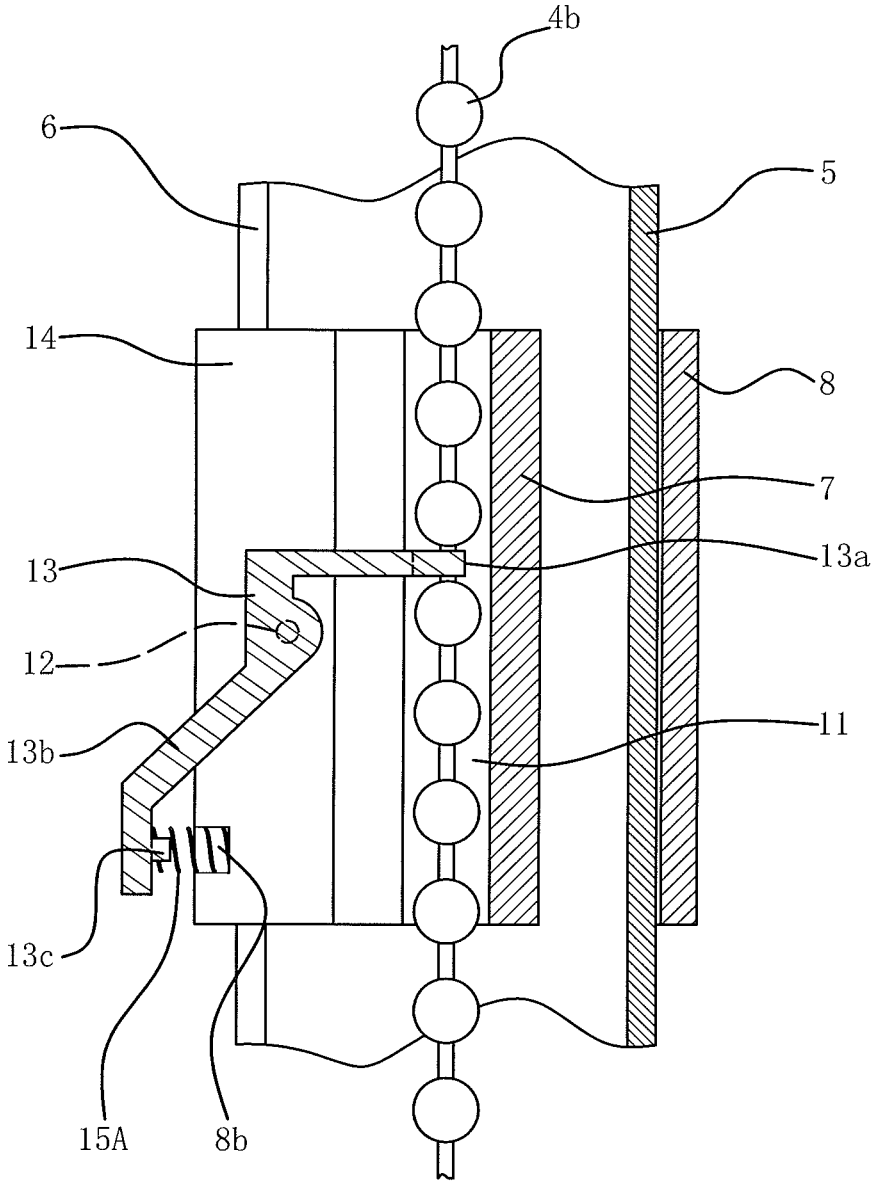
FIG. 5 shows a cross sectional view taken along section line C-C of FIG. 4.

FIGS. 4 and 5 show another embodiment of the bead chain type pull cord mechanism. Specifically, the handle 8 includes a receptacle 8*b* in an outer periphery thereof. The pressing handle 13*b* includes a protrusion 13*c*. The spring 15 shown in FIGS. 2 and 3 is replaced by a spring 15A mounted between the pressing handle 13*b* and an end wall of the receptacle 8*b*. An end of the spring 15A is mounted around the protrusion 13*c*. The spring 15A biases the stop 13*a* to an engaged position sandwiched between the first and second sections 4*a* and 4*b* of the bead chain 4 to prevent movement of the bead chain 4. The pressing handle 13*b* can be operated to overcome the spring 15A and to move the stop 13*a* away from the engaged position, allowing circulating movement of the bead chain 4 to drive the shade 2 through the shade driving mechanism 3.

Although specific embodiments have been illustrated and described, numerous modifications and variations are still possible without departing from the essence of the invention. The scope of the invention is limited by the accompanying claims.

The invention claimed is:

1. A window shade comprising a frame, a shade, a shade driving mechanism, and a bead chain for driving the shade driving mechanism, with the shade driving mechanism fixed to the frame to drive the shade to release or wind, with a barrel mounted to the frame at a location corresponding to the bead chain, with the barrel including a peripheral wall having a slit extending in an axial direction, with a sliding block slideably received in the barrel, with a handle mounted outside of the barrel, with the sliding block connected to the handle by a link extending through the slit, with the bead chain including first and second sections received in the barrel, with a fixed pulley mounted to an end of the barrel, with the bead chain wound around the fixed pulley, with the sliding block fixed to the first section of the bead chain in the barrel, with the sliding block including a passageway in an intermediate portion thereof, with the first section of the bead chain in the barrel fixed in an end of the passageway, with the second section of the bead chain slideably extended through another end of the passageway, with a stop member pivotably mounted by a shaft to the sliding block, and with the stop member including a stop and a pressing handle.

2. The window shade as claimed in claim 1, with the link including a channel in a central portion thereof, with the pressing handle of the stop member connected by the shaft to a peripheral wall of the channel, and with a spring mounted between the channel and the stop.

3. The window shade as claimed in claim 1, with a pulley seat mounted to the end of the barrel, with the fixed pulley rotatably mounted to the pulley seat, and with a compression spring mounted between the pulley seat and the barrel.

4. The window shade as claimed in claim 3, with a shape of cross sections perpendicular to the axial direction of the barrel being one of square, rectangular, circular, elliptic, and polygonal.

5. The window shade as claimed in claim 1, with the handle being a sleeve having a hole, and with the hole having cross sections perpendicular to the axial direction corresponding to that of the cross sections of the barrel.

6. The window shade as claimed in claim 3, with the barrel including a cylindrical hole, with the sliding block including two ends each having an end face, and with each of the end faces of the sliding block having a curve corresponding to that of an inner periphery of the cylindrical hole of the barrel.

7. The window shade as claimed in claim 6, with the sliding block, the link, and the handle integrally formed of plastic by injection molding or integrally formed by processing aluminum alloy, with the barrel made of aluminum alloy or plastic.

8. A window shade comprising a frame, a shade, a shade driving mechanism, and a bead chain for driving the shade driving mechanism, with the shade driving mechanism fixed to the frame to drive the shade to release or wind, with a barrel mounted to the frame at a location corresponding to the bead chain, with the barrel including a peripheral wall having a slit extending in an axial direction, with a sliding block slideably received in the barrel, with a handle mounted outside of the barrel, with the sliding block connected to the handle by a link extending through the slit, with the bead chain including first and second sections received in the barrel, with a fixed pulley mounted to an end of the barrel, with the bead chain wound around the fixed pulley with the sliding block fixed to the first section of the bead chain in the barrel, with the barrel including a receptacle in an outer periphery thereof, with a stop member pivotably mounted to the sliding block, with the stop member including a stop and a pressing handle, with the spring mounted between the pressing handle and an end wall of the receptacle, with the spring biasing the stop to an engaged position sandwiched between the first and second sections of the bead chain to prevent movement of the bead chain, and with the pressing handle operable to overcome the spring and to move the stop away from the engaged position, allowing circulating movement of the bead chain to drive the shade through the shade driving mechanism.

9. The window shade as claimed in claim 8, with the sleeve including a peripheral wall having a slot in communication with the channel, and with the pressing handle of the stop member extending outside of the slot.

* * * * *